US008973777B2

(12) United States Patent
Ramsey et al.

(10) Patent No.: US 8,973,777 B2
(45) Date of Patent: Mar. 10, 2015

(54) BEVERAGE CAN WITH DISC

(75) Inventors: Christopher Ramsey, Oxfordshire (GB); Polly Firth, Oxfordshire (GB); Andrew Phillips, Oxfordshire (GB)

(73) Assignee: Crown Packaging Technology, Inc., Alsip, IL (US)

( * ) Notice: Subject to any disclaimer, the term of this patent is extended or adjusted under 35 U.S.C. 154(b) by 31 days.

(21) Appl. No.: 13/521,921

(22) PCT Filed: Jan. 12, 2011

(86) PCT No.: PCT/EP2011/050364
§ 371 (c)(1),
(2), (4) Date: Jul. 12, 2012

(87) PCT Pub. No.: WO2011/086110
PCT Pub. Date: Jul. 21, 2011

(65) Prior Publication Data

US 2013/0001230 A1 Jan. 3, 2013

(30) Foreign Application Priority Data

Jan. 12, 2010 (EP) ..... 10150507

(51) Int. Cl.
*B65D 1/24* (2006.01)
*B65D 17/00* (2006.01)
*B65D 1/16* (2006.01)

(52) U.S. Cl.
CPC ..... *B65D 17/02* (2013.01); *B65D 1/165* (2013.01); *B65D 2517/0052* (2013.01)
USPC ..... 220/527; 215/6

(58) Field of Classification Search
USPC ..... 220/527, 285, 504; 229/5.8; 215/6, 378; 206/232
See application file for complete search history.

(56) References Cited

U.S. PATENT DOCUMENTS

| | | | | | |
|---|---|---|---|---|---|
| 1,209,998 | A | * | 12/1916 | Pinckert | 40/27.5 |
| 2,174,618 | A | * | 10/1939 | Burdick | 206/581 |
| 4,181,219 | A | | 1/1980 | Marion | |
| 5,524,468 | A | | 6/1996 | Jentzsch et al. | |

FOREIGN PATENT DOCUMENTS

| | | |
|---|---|---|
| DE | 29519352 | 2/1996 |
| DE | 19704522 | 8/1998 |
| EP | 0482581 | 4/1992 |
| EP | 0958182 | 11/1999 |
| WO | WO 96/24539 | 8/1996 |
| WO | WO 98/34843 | 8/1998 |

OTHER PUBLICATIONS

DE19704522 English translation.*

* cited by examiner

*Primary Examiner* — Jeffrey Allen
(74) *Attorney, Agent, or Firm* — Baker & Hostetler LLP

(57) ABSTRACT

A beverage can (1) having a base (10) defining a re-entrant bead (17) in which a resilient disc (50) is held captive. The maximum dimension of the disc (50) is designed to be larger than the internal diameter of the re-entrant bead (17) and thus, when the resilient disc (50) is fitted into the re-entrant bead (17), the disc (50) adopts a concave, domed shape. The degree of doming can accommodate any variance between the dimensions of the disc (50) and that of the reformed base (10) of the can (1). One or more drainage ports may be provided on the periphery of the resilient disc (50) so that any liquid trapped between the surfaces of the base (10) and the resilient disc (50) may drain.

17 Claims, 3 Drawing Sheets

PRIOR ART

BEVERAGE CAN WITH DISC

CROSS-REFERENCE TO RELATED APPLICATIONS

This application is the National Stage of International Application No. PCT/EP2011/050364, filed Jan. 12, 2011, which claims the benefit of EP application number 10150507.1, filed Jan. 12, 2010, the disclosures of which are incorporated herein by reference in their entirety.

TECHNICAL FIELD

The present invention includes a conventional beverage can having a body, which incorporates an integrally domed base and a side-wall, and an end, which is fixed to the open end of the body using conventional techniques, a double seam for example.

BACKGROUND ART

It is already known to internally reform the domed base of a beverage can to provide a re-entrant profile. This technique is primarily used to increase the strength of the base, which in turn allows light weighting. For example, EP 0482581 A (BALL CORP) 29.02.1992 describes an apparatus suitable for reforming the base of a beverage can in this way. In particular, FIG. 11 of this application shows an enlarged cross-section view through a portion of the base of a beverage can after such reforming.

WO 96/24539 (KOHORN INTERNATIONAL PTY LIMIT) 15.08.1996 describes a container formed with an open void separate from the main containment volume. Examples of such containers are metal cans, which are formed with a generally concave or domed void in the base, as commonly used for soft drinks, beer etc. This document describes removal means that are provided to substantially close this void, thereby creating a second containment volume that may be used for promotional goods, a second active ingredient or such like.

Both these ideas are combined in EP 0958182 B (SCHMALBACH LUBECA) 24.11.1999 which describes a two piece beverage can made substantially of sheet metal having a base that is drawn-in to the inner side of the container, so that the diameter of the base is evidently smaller than the diameter of the container. This document also describes a separate disc-shaped component that is adapted to be fixed into the base. The separate disc-shaped component ("false bottom part") is separately produced and may therefore be easily decorated etc.

SUMMARY OF INVENTION

The present invention provides a beverage can (1) having a base (10) defining a re-entrant bead (17) in which a resilient disc (50) is held captive, characterised in that the diametric dimension of the disc (50) is larger than the internal diameter of the re-entrant bead (17) and when the resilient disc (50) is fitted into the re-entrant bead (17), the disc (50) adopts a concave, domed shape.

According to the present invention, a resilient disc is snapped into the re-entrant bead at the base of a beverage can. The disc has a means of removal, by which it can be prised out of the re-entrant bead by a user. For example, the disc may have a cut-out that allows it to be prised out of the re-entrant, bead using a tab or a coin.

The disc and domed base of the beverage can together define a compartment, which can be used to store additives for the contents of the container or an item such as seeds, a compass, USB device etc. The disc is preferably stamped from a printed sheet of thermoplastic material e.g. PP, PET or other polymer, although other materials such as metal or card are also possible The disc may be fitted into the base of the beverage can either before or after filling the can with product, by a can-maker or packer respectively. Preferably, cut-outs are provided in the disc to allow drainage of any liquid that has collected in the compartment. This allows the disc to be optionally fitted prior to pasteurising or rinsing on the filling line.

The inventors have found that the disc can be manufactured to a much tighter tolerance than may be achieved for the diameter of the re-entrant bead and thus, during trials the disc was found to fit tightly in the reformed base of some cans, whereas it only fitted very loosely in the reformed base of other cans. Upon further investigation the inventors found that if the diametric dimension of the disc (i.e. the maximum points of the disc plotted within a circle) was larger than the diameter of the re-entrant bead, the disc could be snapped into the reformed base, but the stresses exerted on the disc by the re-entrant bead, causes the disc to and flex into a concave, dome configuration. Depending upon the dimensions of the disc and the diameter defined by the re-entrant bead of the reformed base (as manufactured), the domed disc takes up a lesser or greater degree of doming.

This variable shaped dome has a number of advantages. Firstly, the degree of doming can accommodate any variance between the dimensions of the disc and that of the reformed base of the can. For example, the disc can be manufactured having a tolerance of +−0.1 mm whereas the reformed base conventionally has a tolerance of +−0.3 mm.

The disc proposed by the invention includes one or more cut-outs arranged on its periphery. The concave, domed shape of the disc once fitted in the reformed base of the can, assists with the drainage of water from the internal surface of the disc and the stressed/fitted disc is more difficult to remove from the base of the can, reducing the risk of accidental separation from the can.

The disc is provided with a removal means, which is sized and shaped to allow a user to remove the disc from the base of the can. The removal means takes the form of a cut-out, which allows a user to insert a lever e.g. a coin or tab, to prise the disc out of the base of the can.

In an embodiment of the invention, the disc and base of the can together define three contact points and the removal means is provided by a cut-away, which allows a user to apply a lever under the disc. The two contact points located on either side of the cut away serve as energising prongs. These energising prongs may be located immediately adjacent to the cut-away or they may be displaced from the cut-away, but they must be located within the same half of the disc as the cut-way. The contact point located diametrically opposite the cut away acts as a pivot. In combination, the energising prongs and the pivot causes the disc to spin upon release from the base of the can, much like the flipping of a coin. This provides the opportunity for a simple decision based game.

BRIEF DESCRIPTION OF DRAWINGS

The present invention will now be described, by way of example only, with reference to the accompanying drawings, in which:

FIG. 1 generally shows a conventional beverage can 1 according to the prior art, having a base 10 with a stand annulus 15, a top 20 and a side-wall 30. In particular, FIG. 1*a* shows a cross section taken through the base 10 of the can illustrated in FIG. 1, which more clearly shows the stand annulus 15 and the concave dome 12 of the base 10.

The base of the can according to the invention is illustrated in FIG. 2, where a resilient disc 50 is shown trapped in the re-entrant bead 17. A compartment (not labelled) is clearly shown, defined between the disc 50 and the domed base of the can 12. The disc 50 may be removed from the re-entrant bead 17, using a lever 60 inserted under the disc 50 via a cut-away 55. FIGS. 3 and 4 show alternative examples of levers 60 suitable for use in the invention. FIG. 3 illustrates how a tab 60' may be used as a lever upon opening and after separation from the top of the can and FIG. 4 illustrates the use of a coin 60".

FIG. 3*a* illustrates a plan view of a disc 50 suitable for use in the invention. This disc 50 has a cut-away 55 to allow insertion of a suitable lever 60 and the disc 50 also defines two energising prongs 51 and a pivot 52. Upon application of a lever 60' by a user of the can (as shown in FIG. 3), the disc 50 is prised from the re-entrant bead (17) and the combined action of the energising prongs 51 and the pivot 52, causes the disc to spin (much like the flip of a coin) upon release from the re-entrant bead 17.

FIGS. 4*a* and 4*b* show an alternative disc 50 suitable for use in the invention. This disc 50 has a cut-away 55 to allow insertion of a suitable lever 60, but the disc 50 is modified to include three large cut-outs (not labelled) between the energising prongs 51 and the pivot 52. These cut-outs minimise the amount of moisture trapped between the disc 50 and the base of the can 10 and also allow any moisture that is trapped to drain/dry out efficiently.

FIG. 5 shows a beverage can 1 according to the invention with an enhanced variant of the disc 50 illustrated in FIGS. 4, 4*a* and 4*b* inserted into the re-entrant bead 17. FIGS. 5*a* and 5*b* show a plan view and isometric view of the enhanced disc 50. Radiuses have been provided on the corners of the contact points (energising prongs and pivot) so there are no longer any sharp corners, as shown FIG. 5*a*. These smoothed corners provide a smooth release as the disc 50 is flipped out of the re-entrant bead 17. This is independent of the degree of doming of the disc (50) caused by the variation in dimensions of the disc and the diameter defined by the re-entrant bead of the reformed base.

Figure 1:
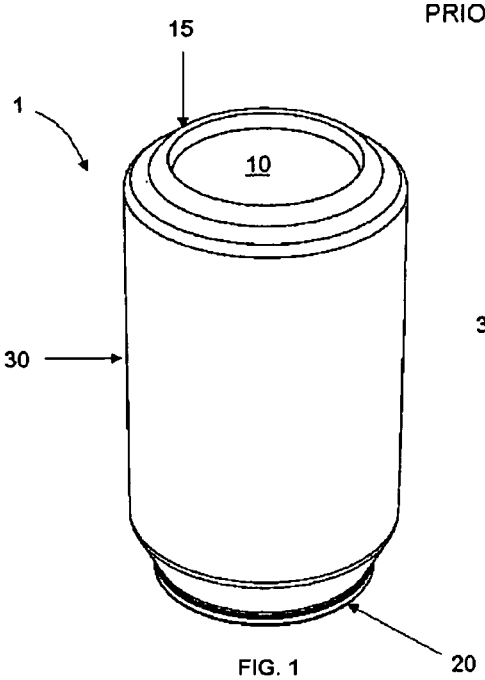
FIG. 1 is an isometric view of an upturned beverage can having a reformed base suitable for use in the invention.
Figure 1A:
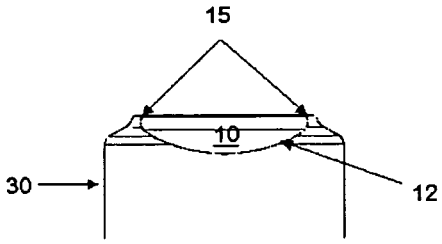
FIG. 1*a* is a section taken through the base of the beverage can shown in FIG. 1.
Figure 2:
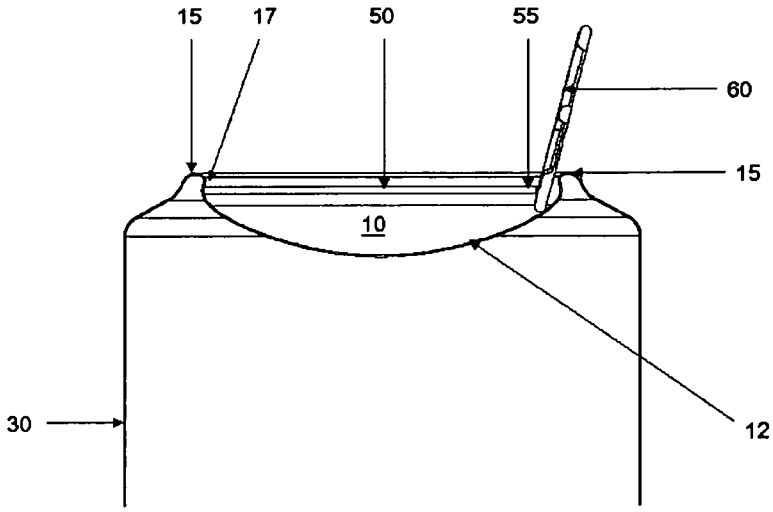
FIG. 2 is a section view of the beverage can according to the invention having a reformed base (as shown in FIG. 1*a*) with a disc constrained therein, illustrating where a user may apply a lever to prise the disc out of the beverage can base.
Figure 3:
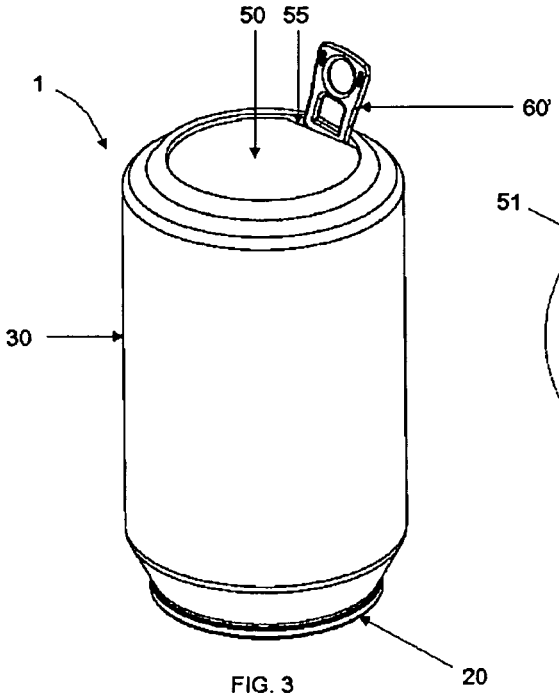
FIG. 3 is an isometric view of an upturned beverage can having a disc according to a first embodiment of the invention, illustrating how a tab may be used as a lever to prise the disc out of the beverage can base.
Figure 3A:
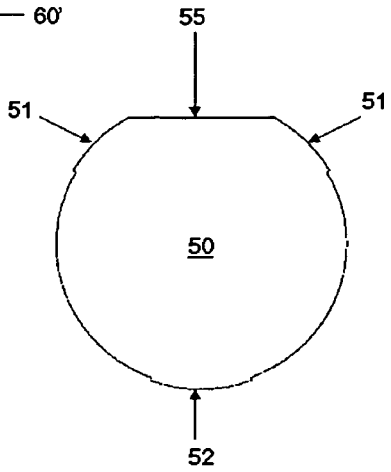
FIG. 3*a* is a plan view of the disc shown fitted in the reformed base of the beverage can shown in FIG. 3.
Figure 4:
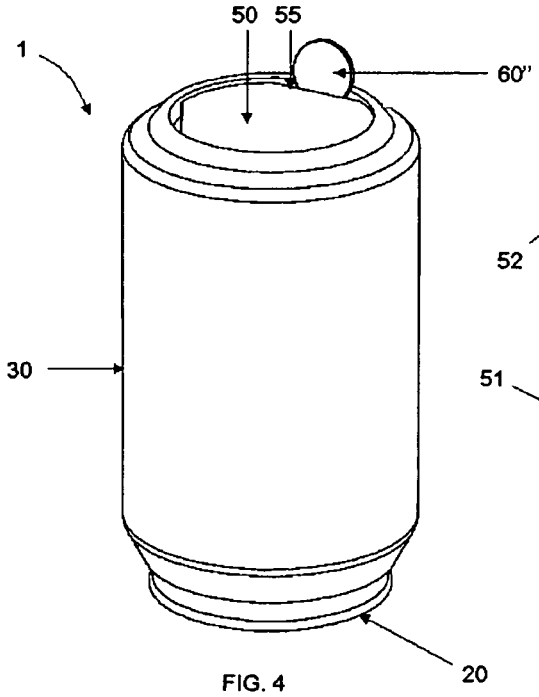
FIG. 4 is an isometric view of an upturned beverage can having a disc according to a second embodiment of the invention, illustrating how a coin may be used as a lever to prise the disc out of the beverage can base.
Figure 4B:
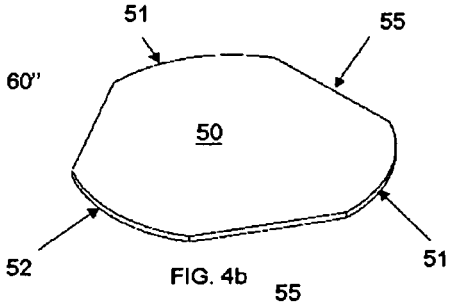
FIG. 4*b* is an isometric view of the disc shown in FIGS. 4 and 4*a*.
Figure 4A:
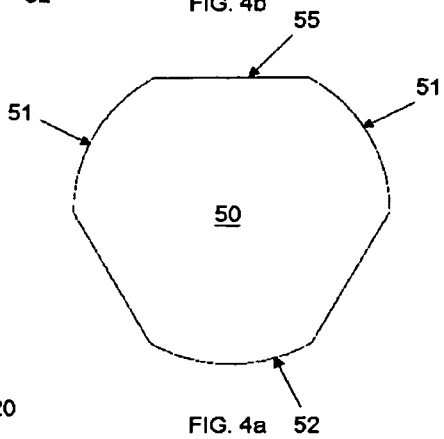
FIG. 4*a* is a plan view of the disc shown fitted in the reformed base of the beverage can shown in FIG. 4.
Figure 5:
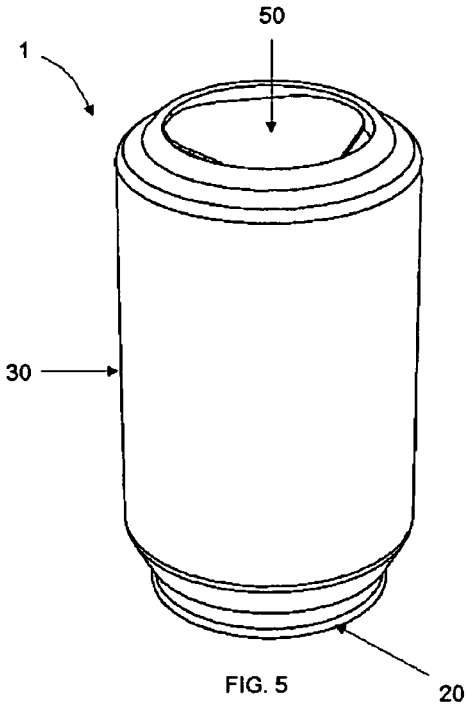
FIG. 5 is an isometric view of an upturned beverage can having a disc according to an enhanced third embodiment of the invention.
Figure 5B:
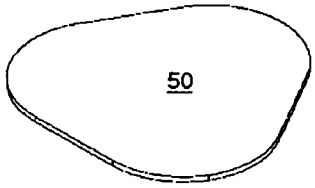
FIG. 5*b* is an isometric view of the disc shown in FIGS. 5 and 5*a*.
Figure 5A:
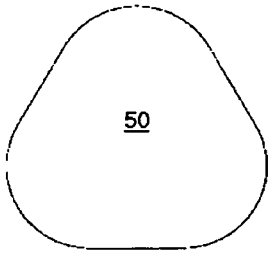
FIG. 5*a* is a plan view of the disc shown fitted in the reformed base of the beverage can shown in FIG. 5.
Figure 6:
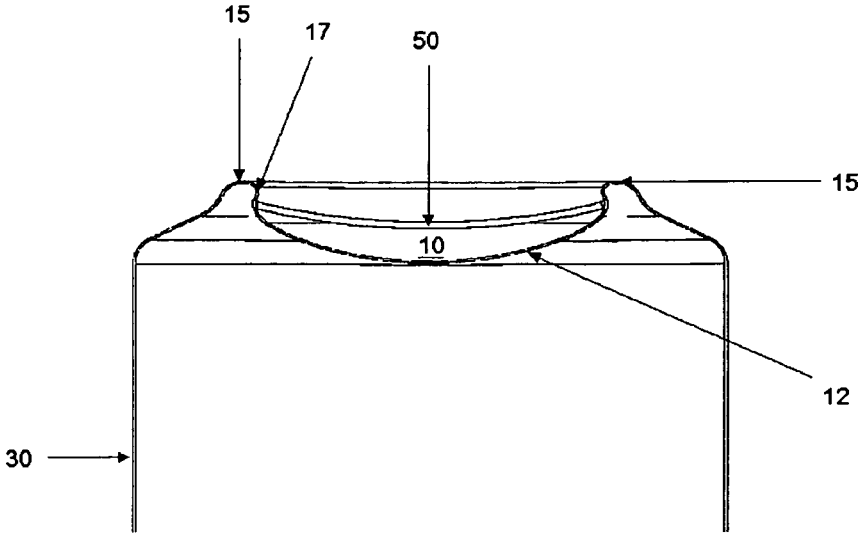
FIG. 6 is a section view of the beverage can according to the enhanced third embodiment of the invention where the diametric dimension of the disc is larger than the maximum diameter of the cavity formed in the reformed base of the beverage can and when the disc is constrained therein, the disc adopts a concave, domed shape.

It will be apparent to those skilled in the art that the different examples of suitable lever devices or means to remove the disc from the can may be applied to any of the examples in the drawings. Furthermore, different cut-away designs and number and/or location of cut-outs may be employed without departing from the general teaching of the invention.

The invention claimed is:

1. A beverage can comprising:

a body with a side-wall and a base, the base including a concave dome defining a recess, and a stand annulus, wherein the base is reformed to provide a re-entrant bead at a junction between the concave dome and the stand annulus, and a resilient disc configured to be disposed in the recess, the resilient disc defining an outer periphery, the outer periphery consisting of three prongs and a plurality of connecting walls spaced about the outer periphery such that each of the three prongs is separated from adjacent prongs by one of the plurality of connecting walls, wherein when the resilient disc is disposed within the recess, each of the three prongs contacts the concave dome and each of the connecting walls are spaced from the concave dome, and wherein at least one of the prongs defines an apex that is diametrically opposite one of the plurality of connecting walls, the one of the plurality of connecting walls being spaced from the concave dome such that the resilient disc is capable of being prised out of the re-entrant bead by a user of the beverage can.

2. A beverage can according to claim 1, wherein the three prongs are configured such that the outer periphery has a slightly larger external diameter compared to a minimum internal diameter of the re-entrant bead.

3. A beverage can according to claim 1, wherein the one of the plurality of connecting walls is spaced from the concave dome such that a removal tool can be inserted between the one of the plurality of connecting walls and the concave dome and two prongs on either side of the one of the plurality of connecting walls energize the disc as it is prised out of the re-entrant bead and the prong diametrically opposite the one of the plurality of connecting walls provides a pivot, causing the disc to spin orthogonal to the plane of the disc, as it is released from the re-entrant bead.

4. A beverage can according to claim 2, wherein the connecting walls each include a linear portion.

5. A beverage can according to claim 1 wherein diametral interference between the resilient disc and the re-entrant bead causes the resilient disc to adopt a convex, domed shape.

6. A beverage can according to claim 1 further comprising a tool useable for a user to remove the disc from the can.

7. A beverage can according to claim 6 wherein the tool is a lever.

8. A method for removing a resilient disc from a bottom of a beverage can, comprising the step of:

prising a resilient disc from a re-formed re-entrant bead that is formed at a junction between a concave dome and a stand annulus of a beverage can, the resilient disc defining an outer periphery, the outer periphery consisting of three prongs, and a plurality of connecting walls spaced about the outer periphery such that each of the three prongs is separated from adjacent prongs by one of the plurality of connecting walls, wherein when the resilient disc is disposed within the recess, each of the three prongs contacts the concave dome and each of the connecting walls are spaced from the concave dome, and wherein at least one of the prongs defines an apex that is diametrically opposite one of the plurality of connecting walls.

9. The method of claim 8 wherein the prising step includes inserting a tool into a space between one of the connecting walls and the concave dome.

10. The method of claim 9 wherein the three prongs are configured such that the outer periphery has a slightly larger external diameter compared to a minimum internal diameter of the re-entrant bead.

11. The method of claim 9 wherein the one of the plurality of connecting walls is spaced from the concave dome such that a removal tool can be inserted between the one of the plurality of connecting walls and the concave dome and two prongs on either side of the one of the plurality of connecting walls energize the disc as it is prised out of the re-entrant bead and the prong diametrically opposite the one of the plurality of connecting walls provides a pivot, causing the disc to spin orthogonal to the plane of the disc, as it is released from the re-entrant bead during the prising step.

12. The method of claim 9 wherein diametral interference between the resilient disc and the re-entrant bead causes the resilient disc to adopt a convex, domed shape.

13. A beverage can comprising:

a body with a side-wall and a base, the base including a concave dome defining a recess, and a stand annulus, wherein the base is reformed to provide a re-entrant bead at a junction between the concave dome and the stand annulus, and a resilient disc configured to be disposed in the recess, the resilient disc defining an outer periphery, the outer periphery consisting of three prongs and a plurality of connecting walls spaced about the outer periphery such that each of the three prongs is separated from adjacent prongs by one of the plurality of connecting walls, wherein when the resilient disc is disposed within the recess, each of the three prongs contacts the concave dome and each of the connecting walls are spaced from the concave dome, and wherein at least a portion of one of the connecting walls extends linearly between adjacent prongs.

14. The beverage can of claim 13, wherein each of the plurality of connecting walls include at least a portion that extends linearly between adjacent prongs.

15. The beverage can of claim 14, wherein each of the linear portions defines a straight line and the straight lines of adjacent connecting walls intersect at a location radially outward from the outer periphery of the disc.

16. A beverage can according to claim 13, wherein the three prongs are configured such that the outer periphery has a slightly larger external diameter compared to a minimum internal diameter of the re-entrant bead.

17. A beverage can according to claim 13, wherein the one of the plurality of connecting walls is spaced from the concave dome such that a removal tool can be inserted between the one of the plurality of connecting walls and the concave dome and two prongs on either side of the one of the plurality of connecting walls energize the disc as it is prised out of the re-entrant bead and the prong diametrically opposite the one of the plurality of connecting walls provides a pivot, causing the disc to spin orthogonal to the plane of the disc, as it is released from the re-entrant bead.

* * * * *